US005367776A

United States Patent [19]

Chong

[11] Patent Number: 5,367,776

[45] Date of Patent: Nov. 29, 1994

[54] CAN OPENER

[76] Inventor: Wun C. Chong, 69 Wallace Place, Delta, British Columbia, V4M 3S2, Canada

[21] Appl. No.: 144,465

[22] Filed: Nov. 1, 1993

[51] Int. Cl.[5] ..... B67B 7/46; B67B 7/72

[52] U.S. Cl. ..... 30/417; 30/419; 30/426

[58] Field of Search ..... 30/417, 418, 426, 422, 30/424, 419

[56] References Cited

U.S. PATENT DOCUMENTS

| | | | |
|---|---|---|---|
| 3,110,962 | 11/1963 | Krist et al. | 30/418 |
| 3,161,952 | 12/1964 | Czapiewski | 30/418 |
| 4,726,119 | 2/1988 | Lee | 30/418 |
| 4,782,594 | 11/1988 | Porucznik et al. | 30/417 |
| 5,121,546 | 6/1992 | Chong | 30/417 X |

FOREIGN PATENT DOCUMENTS

| | | | |
|---|---|---|---|
| 1252374 | 11/1971 | United Kingdom | 30/417 |

*Primary Examiner*—Rinaldi I. Rada

[57] ABSTRACT

A can opener comprising a housing having a handle. A cutting wheel having a cutting edge for severing a can wall is mounted in the housing. There is a traction wheel having a gripping surface to engage the can. The traction wheel are rotatable and the axis rotation is substantially perpendicular to each other. The wheels are positioned adjacent and spaced apart from each other to define a gap to accept a can to be opened. One of the wheels is movable towards the other to engage and lock the can between the cutting wheel and the traction wheel. The cutting wheel then acts to sever the can wall and the traction wheel acts to move the can past the cutting wheel. There is a first thrust surface associated with the housing and a space, adjacent, second thrust surface associated with the movable wheel. The first and second thrust surfaces comprises cooperable can surfaces rotatable relative to each other to reciprocate the first and second thrust surfaces relative to each other between a first position where the gap to receive the can is relatively wide, and a second position where the can is engaged and locked between the cutting wheel and the traction wheel. There is a handle to permit one of the wheels to be rotated by hand.

17 Claims, 2 Drawing Sheets

CAN OPENER

FIELD OF THE INVENTION

This invention relates to a can opener. It is directed particularly to that type of can opener that cuts the outer seam wall of a can.

DESCRIPTION OF THE PRIOR ART

Can openers are well known. In general they comprise a traction wheel and a cutting wheel. One wheel can be rotated and the traction wheel acts as a reaction surface and also acts to drive the can opener around the top of the can while the sharpened cutting wheel cuts through the can. The most popular type of can opener available is probably the type that cuts the top end of the can to gain access to the can contents. The main problem with this mode of operation is that the cutting blade tends to come into contact with the contents of the can and if the cutting blade is not particularly sharp, it would tend to form small shavings that can contaminate the contents of the can. If the entire circumference of the can top is cut then the top falls into the can contents and can be difficult and messy to remove from the can.

To address these problems, can openers have been developed that are designed to cut the outside seam of the can. Examples of these can openers include U.S. Pat. No. 3,719,991 to French; U.S. Reissued Pat. No. 27,504 to Smith; U.S. Pat. No. 1,935,680 to Von Wolforsdorf; U.S. Pat. No. 4,782,594 to Porucznik et al. and U.S. Pat. No. 3,510,941 to Fyfe. All these patents use a can including a pin sliding in an arcuate slot for engaging and locking the can opener on the can to be opened. While these arrangements work adequately, over time there is a tendency for the moving parts to wear with the result that the engaging and locking function of the opener is impaired leading to difficulty in cutting the can and keeping the opener in position on the can.

My own U.S. Pat. No. 5,121,546 has proved an effective solution of the above problem. In the can opener of that patent, there are thrust surfaces and a separating means that can be introduced between the thrust surfaces. The separating means, typically a ball bearing, is introduced between the thrust surfaces and moves a movable thrust surface away from a fixed thrust surface to separate a movable wheel, usually the traction wheel, and a cutting wheel. By this means, the can opener is brought to the cutting position. The wheel can then be rotated to cut the can.

The can opener of my above U.S. patent has proved to be extremely effective. However, experiments with groups of people have shown that a certain dexterity is required in its use and that dexterity is not always present. As a result, there have been complaints not about the utility or durability of the can opener but about its mode of use.

SUMMARY OF THE INVENTION

Accordingly the present invention seeks to provide a can opener clearly related to the can opener described and claimed in my U.S. Pat. No. 5,121,546 and having all the advantages of that can opener but relying on a different mode of operation.

Accordingly the present invention provides a can opener comprising a housing having a handle; a cutting wheel having cutting edge for severing a can wall, said cutting wheel defining a cutting wheel axis; a traction wheel having a gripping surface to engage a can, said traction wheel defining a traction wheel axis; means rotatably mounting said traction wheel and said cutting wheel in said housing such that their axes are substantially perpendicular and said wheels are positioned adjacent and spaced apart from each other to define a gap to accept a can to be opened, one of said wheels being movable towards the other to engage and lock said can between said cutting wheel and said traction wheel so that said cutting wheel acts to sever said can wall and said traction wheel acts to move said can past said cutting wheel; a first thrust surface associated with said housing and a spaced, adjacent, second thrust surface associated with said moveable wheel; said first and second thrust surfaces comprising cooperable cam surfaces rotatable relative to each other to reciprocate said first and second thrust surfaces relative to each other between a first position, where said gap is relatively wide, and a second position where said can is engaged and locked between said cutting wheel and said traction wheel; means associated with one of said wheels to permit rotation thereof.

DESCRIPTION OF THE DRAWINGS

Aspects of the present invention are illustrated, by way of example, in the drawings in which.

DESCRIPTION OF THE PREFERRED EMBODIMENTS

Figure 1:
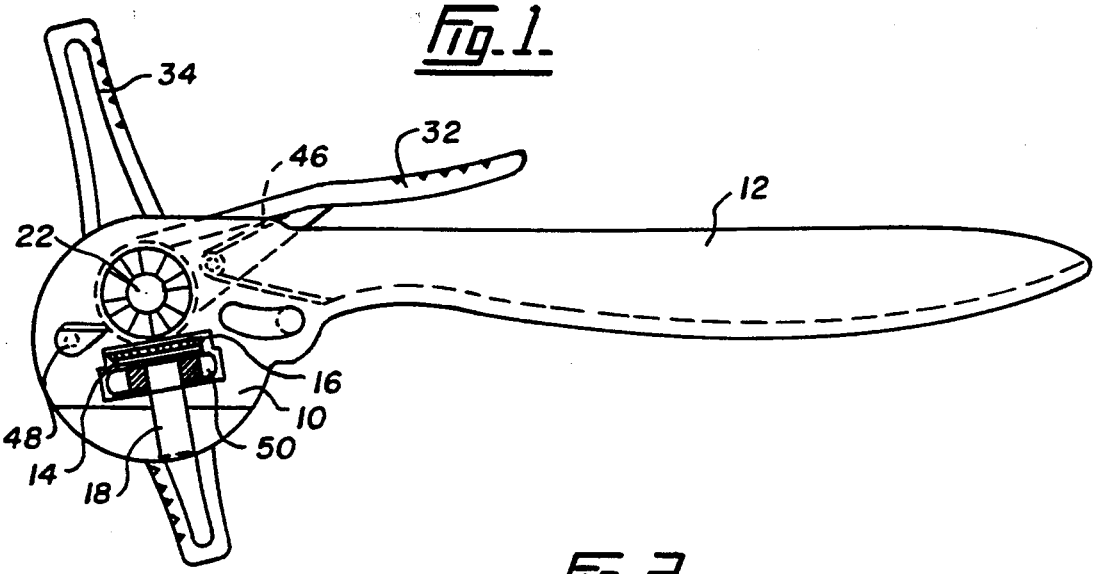
FIG. 1 is a side elevation of a can opener according to the present invention.

The drawings show a can opener comprising a housing 10 having a handle 12. There is a cutting wheel 14 with a cutting edge 16 for severing a can wall 17, as shown in FIGS. 2 to 5. The cutting wheel 14 is mounted on a rotatable spindle 18 that defines a cutting wheel axis. A traction wheel 20 has a gripping surface in the form of teeth as shown particularly in FIG. 3. The traction wheel 20 is mounted on a second rotatable spindle 22 that defines a traction wheel axis. The cutting wheel 14 and traction wheel 20 are mounted in housing 10 so that spindles 18 and 22, and thus the axes of rotation of wheels 14 and 22, are substantially perpendicular and the wheels are positioned adjacent but spaced from each other to define a gap 24 able to accept a can to be opened. The gap is shown in FIG. 4.

Figure 2:
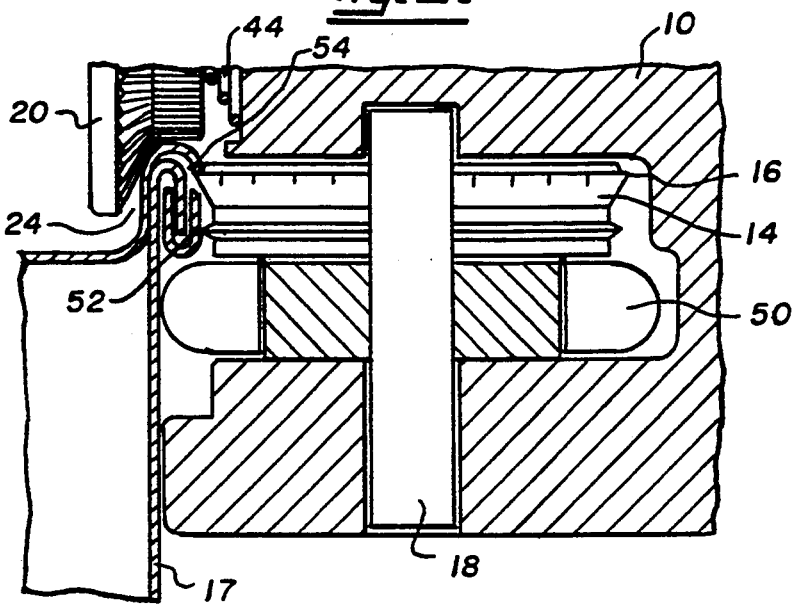
FIG. 2 is a detail, on an enlarged scale, of the can opener of FIG. 1.
Figure 4:
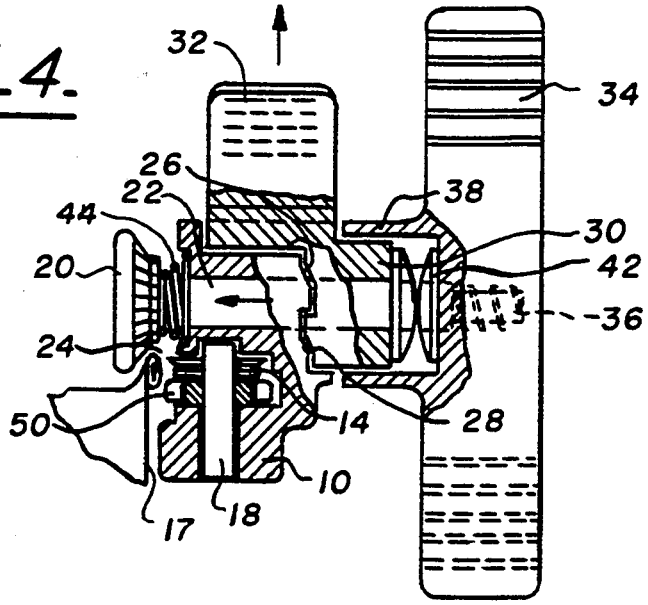
FIGS. 4 and 5 illustrate the operation of the can opener of FIGS. 1 to 3.
Figure 5:
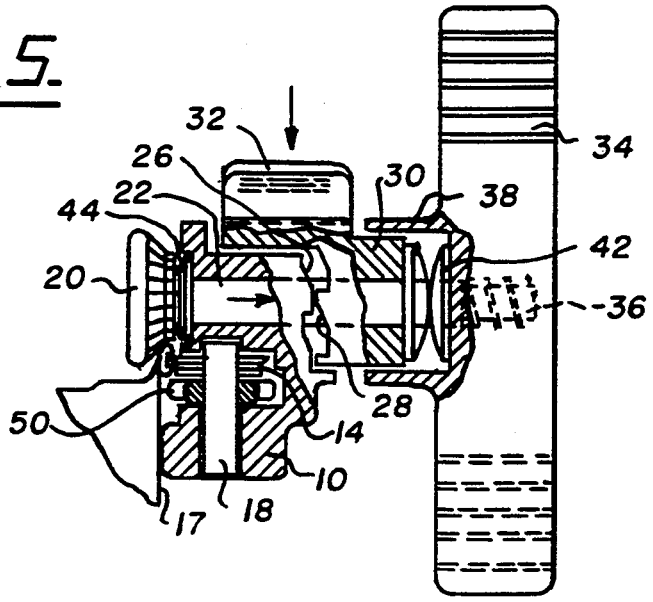

One of the wheels 14 and 20 is movable towards the other to close the gap 24 thereby engaging and locking a can, as shown in FIGS. 2 and 5, to be opened between the cutting wheel 14 and the traction wheel 20. When a can is so engaged, the cutting wheel 14 acts to sever the can wall 17, as shown most clearly in FIGS. 2 and 4. This is achieved by the cutting wheel 14 severing the can seam as the traction wheel 20 acts to move the can past the cutting wheel 14.

In the illustrated embodiment, the traction wheel 20 is the wheel that is movable towards cutting wheel 14. The movement is possible due to the traction wheel spindle 22 being mounted within housing 10 for axial movement as indicated by the arrow in FIGS. 4 and 5.

The movement of the traction wheel 20 along the traction wheel spindle 22 is accomplished using a first thrust surface 26, associated with housing 10 and a spaced, adjacent, second thrust surface 28 formed on a secondary housing 30. The first thrust surface 26, being part of the housing 10, remains stationary with respect to the housing 10 at all times. The second thrust surface 28 is part of secondary housing 30. Lever 32, as shown most clearly in FIG. 1 but as also shown in FIGS. 4 and 5, extends from housing 30. The thrust surfaces 26 and 28 form cam surfaces that can be rotated relative to each other by downward movement of the lever 32 to reciprocate the secondary housing 30 in the first, open position shown in FIG. 4 to the second closed position shown in FIG. 5. In doing so the traction wheel 20 is moved inwardly, that is towards the cutting wheel 14 as shown in FIG. 5.

Figure 6:
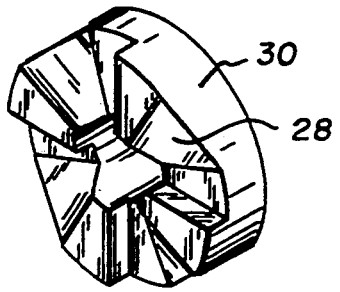
FIG. 6 shows a detail of the can opener of the preceding FIGURES.

FIG. 6 shows, in perspective view, the secondary housing 30 and is included to illustrate the shape of a typical thrust surface 28. The first thrust surface 26, which is part of the housing 10, is correspondingly shaped, as probably shown most clearly in FIGS. 4 and 5.

There is a handle 34 mounted on the traction wheel spindle 22 at 36. The traction wheel spindle 22 can be rotated by rotating the handle 34, which offers the conventional mechanical advantage. There is a housing 38 extending from one side of the handle 34 to receive the secondary body 30. Dome spring washers 42 facilitate rotation of the handle 34 relative to the secondary housing 30. There is also a spring 44, mounted on the distal end of the traction wheel spindle 22 to ensure that when the lever 32 is raised, to the position shown in FIG. 4, the traction wheel 20 will move outwardly under the influence of the spring 44.

The opener includes a spring 46 that urges the lever 32 to the raised position, that is the position shown in FIGS. 1 and 4.

There are abutment means to guide the movement of the can opener of the present invention about the can during cutting. There is a flange 48, located behind the cutting and traction wheels 14 and 22 to engage the top surface of the can seam wall, as shown particularly in FIG. 3. A further abutment member 50 is provided in the form of a bearing mounted on a spindle 18. The bearing 50 abuts the wall 17 of the can, just beneath the seam.

As shown particularly in FIG. 2 in a preferred aspect of the present invention, the cutting wheel is also formed with a subsidiary scoring edge 52 that will engage the seam of the can, but not cut through it, to guide the cutting wheel 14.

Figure 3:
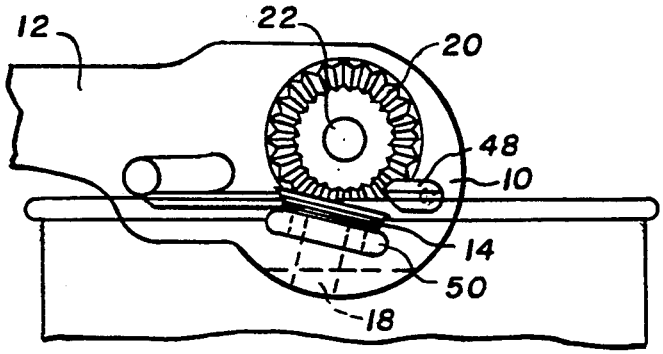
FIG. 3 is a further detail of the can opener of FIG. 1 in position on a can.

As shown in FIGS. 1 and 3, the cutting wheel spindle 18 is preferably mounted at an angle to the vertical. This has been found to improve the engagement of the cutting wheel with the can seam. An appropriate angle is about 12.5° from the vertical.

The cutting wheel 16 is desirably formed with a raised lip 54 as shown particularly in FIG. 2. The raised lip 54 is located behind the cutting wheel 14 and acts to fold under the cut edge of the can to eliminate sharp edges. The raised lip 54 has a periphery having a concave configuration, which ensures that the cut edge of the can top is neatly folded.

The can opener of the present invention is easy to use. The can opener is placed over a can, as shown in FIG. 4, with the lever 32 raised. The lever 32 is pressed downwardly, for example with the thumb, to rotate the secondary housing 30. Rotation of housing 30 ensures that the cam surfaces 26 and 28 move the housing 10 out to the position shown in FIG. 5 and, in doing so, close the gap 24 to grip the can.

With the lever 32 depressed, the handle 34 may be rotated. The traction wheel 20 then drives around the can and the cutting wheel 14 cuts through the edge of the seam, as shown particularly in FIGS. 2 and 5. The various guiding features and the lip 54 ensure that a very neat, regular cut, without sharp edges, is made.

Although the forgoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

I claim:

1. A can opener comprising:

a housing having a handle;

a cutting wheel having a cutting edge for severing a can wall, said cutting wheel defining a cutting wheel axis;

a traction wheel having a gripping surface to engage a can, said traction wheel defining a traction wheel axis;

means rotatably mounting said traction wheel and said cutting wheel in said housing such that their axes are substantially perpendicular and said wheels are positioned adjacent and spaced apart from each other to define a gap to accept a can to be opened, one of said wheels being movable towards the other to engage and lock said can between said cutting wheel and said traction wheel so that said cutting wheel acts to sever said can wall and said traction wheel acts to move said can past said cutting wheel;

a first thrust surface associated with said housing and a spaced, adjacent, second thrust surface associated with said movable wheel;

said first and second thrust surfaces comprising cooperable cam surfaces rotatable relative to each and being formed with projections and recesses, the projections on one surface being able to abut the projections on the other surface to define a first position for the first and second thrust surfaces where said can is engaged and locked between said cutting wheel and said traction wheel and the projections on one surface being received within the recesses on the other surface to define a second position where said gap is relatively wide; and means associated with one of said wheels to permit rotation thereof.

2. A can opened as claimed in claim 1 in which said means rotatably mounting said cutting wheel and said traction wheel comprises a pair of spindles rotatably mounted in said housing, one spindle for each of said wheels.

3. A can opener as claimed in claim 2 in which said movable wheel is said traction wheel by virtue of said traction wheel spindle being axially movable within said housing.

4. A can opener as claimed in claim 2 in which said means to effect rotation of one of said wheels is a handle transversely mounted to one of said spindles.

5. A can opener as claimed in claim 4 in which said handle is mounted to the spindle supporting said traction wheel.

6. A can opener as claimed in claim 2 including a roller bearing mounted on said spindle mounting said cutting wheel, said bearing abutting the wall of the can beneath the seam.

7. A can opener as claimed in claim 1 in which said movable wheel is said traction wheel.

8. A can opener as claimed in claim 1 in which said cutting wheel is adapted to engage one side of the seam wall of a can and the traction wheel is adapted to engage the other side of the seam wall.

9. A can opener as claimed in claim 8 in which said cutting wheel engages the outer side of the seam wall.

10. A can opener as claimed in claim 1 including can abutment means for guiding the movement of said can opener about the can during the cutting operation.

11. A can opener as claimed in claim 10 in said abutment means includes an abutment member adapted to engage with the top seam edge of the can and a further abutment member adapted for engagement with the side wall of said can.

12. A can opener as claimed in claim 1 in which said cutting wheel includes a circumferential cutting edge having a raised lip behind the cutting edge that acts to fold the cut edge of a can under.

13. A can opener as claimed in claim 1 in which said cutting member is positioned at an angle with respect to the vertical.

14. A can opener as claimed in claim 1 in which said movable wheel is normally biased outwardly of the housing so that the gap is open for receiving a can to be opened.

15. A can opener as claimed in claim 14 in which the movable wheel is biased outwardly by a spring.

16. A can opener as claimed in claim 1 in which the cutting wheel has an additional, peripheral sharpened edge to engage the seam wall of the can and act to guide the cutting wheel.

17. A can opener as claimed in claim I in which there are inclined surfaces between a projection and its neighboring recess to facilitate relative rotation of the cam surface.

* * * * *